US005732451A

United States Patent [19]

Mars

[11] Patent Number: 5,732,451

[45] Date of Patent: Mar. 31, 1998

[54] MAGNETIC ATTACHMENT DEVICE

[76] Inventor: Mary Kay Mars, 3221 Royal La., Dallas, Tex. 75229

[21] Appl. No.: 824,562

[22] Filed: Mar. 26, 1997

[51] Int. Cl.[6] ..... A44B 21/00

[52] U.S. Cl. ..... 24/303; 24/356; 24/709.2

[58] Field of Search ..... 24/303, 709.2, 24/356; 63/29.1

[56] References Cited

U.S. PATENT DOCUMENTS

| | | | |
|---|---|---|---|
| 2,274,269 | 12/1942 | Jellinek . | |
| 2,639,482 | 5/1953 | Hestermann | 24/709.2 X |
| 2,712,191 | 7/1955 | Hillenbrand | 24/303 X |
| 3,129,477 | 4/1964 | Mizuno | 24/303 |
| 3,416,195 | 12/1968 | Borthwick | 24/303 X |
| 3,850,010 | 11/1974 | Noto . | |
| 4,231,137 | 11/1980 | Fujimoto | 24/303 |
| 5,031,344 | 7/1991 | Goroza | 24/303 X |
| 5,050,276 | 9/1991 | Pemberton | 24/303 |
| 5,245,844 | 9/1993 | Panzer . | |
| 5,432,986 | 7/1995 | Sexton | 24/303 |

FOREIGN PATENT DOCUMENTS

| | | | |
|---|---|---|---|
| WO86/07271 | 12/1986 | WIPO | 24/303 |

*Primary Examiner*—James R. Brittain

*Attorney, Agent, or Firm*—Peter J. Thoma; Daniel J. Chalker

[57] ABSTRACT

A device for magnetically attaching jewelry, name tags or the like to garments. The device includes inner and outer magnets and an anchor attached to the outer magnet. A pin-secured jewelry article or name tag is secured to the garment by passing the pin through a passageway in the anchor and then bringing the inner and outer magnets into magnetically close proximity on opposite sides of the garment.

32 Claims, 2 Drawing Sheets

FIG. 1
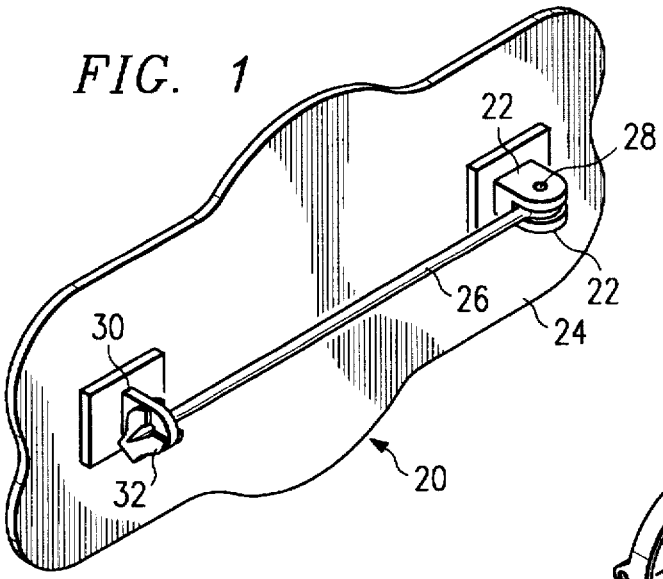
FIG. 2
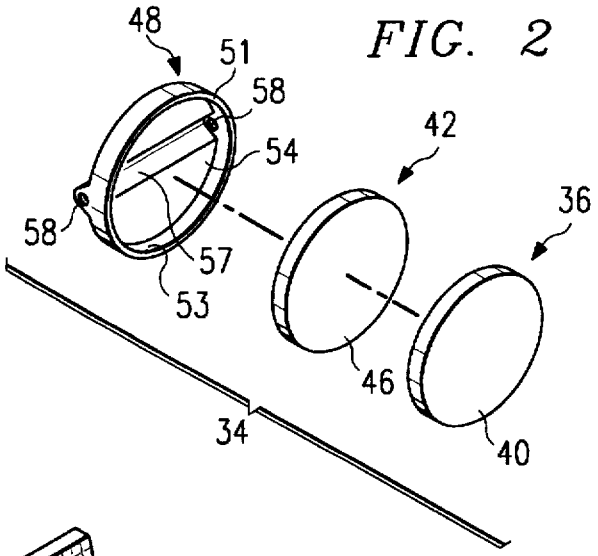
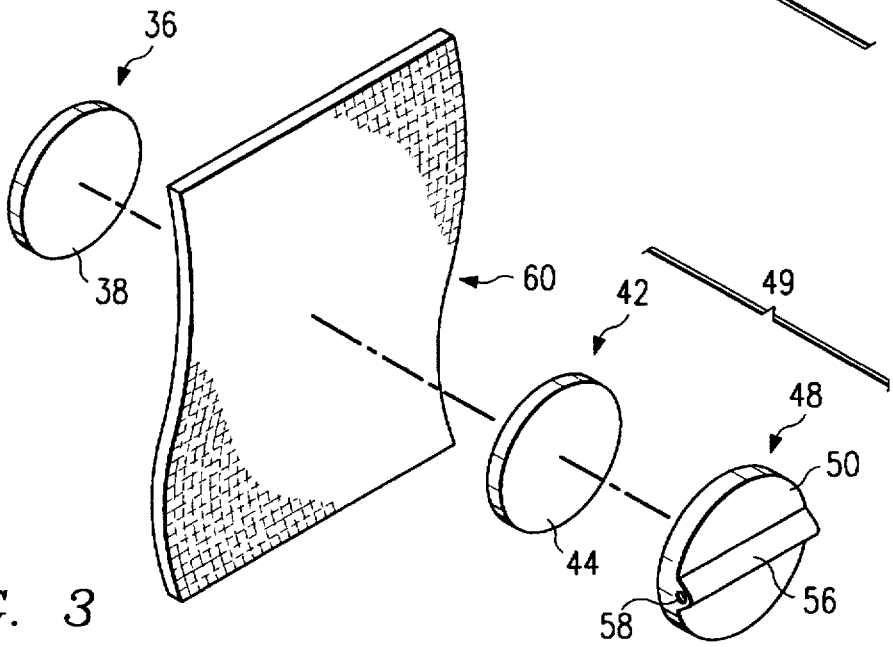
FIG. 3

MAGNETIC ATTACHMENT DEVICE

BACKGROUND OF THE INVENTION

The present invention relates to the attachment of jewelry, name tags and similar articles to garments, and more particularly to devices for magnetically attaching brooches, buttons, insignia, jewelry, name tags, ribbons, stick pins, and other decorative or informative articles to garments.

The attachment of decorative articles, such as brooches, buttons, jewelry or stick pins to garments is a common practice. At business and social functions, people are often asked to attach informative articles, such as name tags or buttons to their garments. Such decorative or informative articles typically have a hinged pin and clasp on the back. The decorative or informative article is attached to a garment by inserting the pin through the front of the garment, passing the pin underneath the garment for a short distance and then bringing the pin back out to the front side of the garment, whereupon the pin is secured in the closed position. The holes created by the pin can cause unacceptable damage to the garment, especially when the garment is made from fine silk or other delicate fabric. Even more durable fabrics are not immune to such damage, especially after repeated use of these decorative or informative articles.

Reluctant to damage their fine clothing, many people avoid wearing brooches and similar pin-secured jewelry articles, and refuse to wear pin-secured name tags or other informative articles. There is, accordingly, a need for a method of attaching these decorative or informative articles to garments without damaging the garments.

SUMMARY OF THE INVENTION

In accordance with the present invention, a device is provided for magnetically attaching brooches, buttons, insignia, jewelry, name tags, ribbons, stick pins, and other decorative or informative articles to garments without damaging the garment with pin holes.

The decorative or informative article has a pin attachment mechanism on its back surface. The device of the present invention includes an inner magnet, an outer magnet and an anchor attached to the outer magnet. The anchor includes a passageway for insertion of a pin of a pin-backed decorative or informative article. When the article is attached to the anchor by passing the pin through the passageway, the article can be attached to the garment by bringing the inner and outer magnets into magnetically close proximity on the opposite sides of the garment.

The presently preferred way of carrying out the invention is described in detail below with reference to the accompanying drawings.

BRIEF DESCRIPTION OF THE DRAWINGS

FIG. 1 is a perspective view of a typical pin and clasp arrangement attached to the rear face of a decorative or informative article;

FIG. 2 is an exploded perspective view of a device in accordance with a preferred embodiment of the invention;

FIG. 3 is an exploded perspective view of the device of FIG. 2 and a portion of a garment, which is shown broken away, the point of view differing from that of FIG. 2 to show the opposite faces of the device;

DESCRIPTION OF THE PREFERRED EMBODIMENTS

Figure 4:
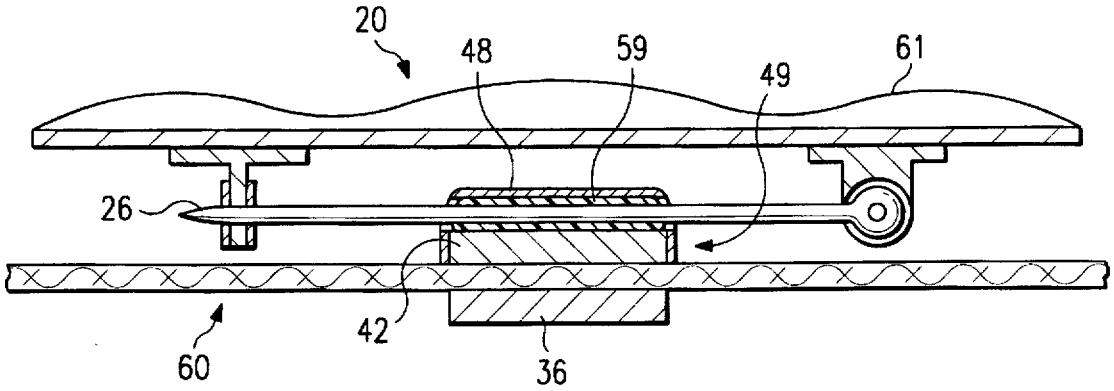
FIG. 4 is a cross-sectional view of the device of FIG. 2 attached to a typical pin of a decorative or informative article and a garment, shown partially, the article having a pin inserted/through an anchor attached to an outer magnet disposed adjacent to an inner magnet on the opposite side of the garment.

Referring to FIG. 1, a decorative or informative article, such as a brooch, button, insignia, jewelry, name tag, ribbon, or stick pin, is indicated generally by reference numeral 20. The particular article 20 may be any conventional article with which the innovative device can be used. FIG. 1 illustrates the back of the article 20 to which a typical pin and clasp mechanism are secured. A pair of parallel spaced plates 22 are attached to and extend from the rear surface 24 of the article 20. A pin 26 is pivotally or hingedly secured between the plates 22 by a shaft 28. Also attached to and extending from the rear surface 24 is a clasp 30 positioned adjacent to the free end of the pin 26 when the pin 26 is in the closed position. The clasp 30 includes a latch 32 for locking the pin 26 in the closed position. The elements described above illustrate a typical mechanism for attaching the article 20 to a garment (not shown) using the pin 26 and clasp 30.

Referring to FIGS. 2 and 3, a magnetic attachment device according to the invention is indicated generally by reference numeral 34 and comprises an inner magnet 36, an outer magnet 42 and an anchor 48. The inner magnet 36 has a first surface 38 defining a first magnetic pole (e.g., north) and a second surface 40 defining a second magnetic pole (e.g., south) opposite in polarity to the first magnetic pole. The outer magnet 42 has a first surface 44 defining a first magnetic pole (e.g., north) and a second surface 46 defining a second magnetic pole (e.g. south) opposite in polarity to the first magnetic pole. In this embodiment, the magnets 36 and 42 are identical disk-shaped magnets. As seen in FIG. 3, they are placed on opposite sides of a garment 60 to secure an informative or decorative article to the garment in a manner described more fully below.

The anchor 48 is preferably a socket defined by a back plate 50 and a cylindrical rim 51. The inner wall 53 of the rim 51 and inner wall 54 of the back plate 50 define a receptacle or cavity shaped to conform to the shape of the outer magnet 42 and snugly hold the magnet 42 therein. The diameter of the outer magnet 42 is just slightly smaller than the diameter of the inner wall 53 so that the outer magnet can be inserted in the cavity of the socket 48. The outer magnet 42 can be secured in the socket 48 by crimping the rim 51 to tightly engage the edge of the outer magnet. It will be understood that in use the outer magnet 42 and socket 48 define a single assembled unit 49 of the magnetic attachment device 34.

The socket 48 has a raised portion 56 on the back plate 50 defining an elongated passageway 57 connecting openings 58 on opposite sides of the socket 48. The passageway 57 and openings 58 are sized to permit the insertion of a typical pin 26 of the type shown in FIG. 1. The socket 48 is preferably metal such as copper or brass and is shaped by stamping from a sheet. Thus, the cylindrical rim 51 and raised portion 56 can be formed in a single stamping operation. To provide an attractive appearance and corrosion-resistant surface, the socket 48 is preferably nickel, silver, gold, or platinum plated after stamping.

The rim 51 is shaped to receive the outer magnet 42 such that when the first surface 44 of the outer magnet 42 is flush against the inner wall 54 of the back plate 50, the second surface 46 of the outer magnet is substantially flush with the free edge of the rim 51. The outer magnet 42 may be frictionally secured within the cavity defined by the walls 53 and 54, and may be further secured with an adhesive applied within the cavity. Preferably, however, before the outer magnet 42 is inserted into the socket 48, a small amount of a soft polymer coating is placed within the passageway 57. After the outer magnet 42 is inserted into the socket 48, the rim 51 is crimped against the edges of the magnet 42.

Referring to FIG. 4, the article 20 is shown secured to a garment 60. A decorative outer face 61 of the article 20 is exposed in essentially the same manner as if the article had been secured by passing the pin 26 through the garment 60. The article 20 can be attached to the anchor or socket 48 by passing the pin 26 through the passageway 57 and openings 58 and securing the pin 26 in the closed position. The assembled article 20 and socket 48 can be secured to the garment 60 by bringing the inner magnet 36 and the outer magnet 42 into magnetically close proximity, with their magnetic poles oriented to attract each other, on the opposite sides of a portion of the garment 60.

Figure 5:
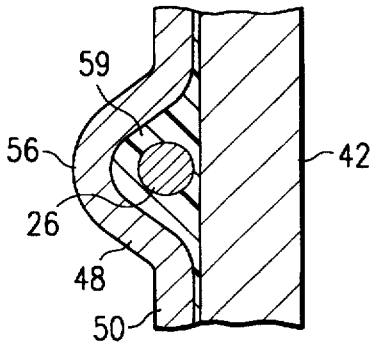
FIG. 5 is a partial cross section taken perpendicular to the longitudinal axis of the pin and through the center of the outer magnet and anchor of FIG. 4.

Referring to FIG. 5, a center section of the socket 48 is shown with the outer magnet 42 installed therein. The passageway beneath the raised portion 56 is filled with a soft polymer coating 59, which extends beyond the passageway to form a thin film between the flat adjacent surfaces of the back plate 50 and the magnet 42. The polymer coating 59 is soft enough to permit a typical pin 26 to be pushed through the passageway of the socket 48 in the manner depicted in FIG. 4. The polymer coating 59 frictionally engages the pin 26 once inserted through the passageway so that the article 20 will not slide, rotate or wobble relative to the socket 48. Various polymer coatings 59 can perform this function, a clear 100% silicone sealant manufactured by Dow Coming being a suitable example. It has been found that such silicone material will permit many insertions and withdrawals of a typical pin 26 without losing the ability to prevent sliding, rotation or wobbling of the article 20 relative to the socket 48.

Referring again to FIG. 3, since the inner magnet 36 is placed inside a garment 60, the inner magnet 36 is preferably disk-shaped or has rounded edges so that it does not scratch or irritate the person wearing the magnetic attachment device 34. The inner magnet 36 is also preferably small enough to be comfortably worn in close proximity to a person's skin, yet large enough to facilitate easy handling and positioning of the inner magnet 36 inside the garment 60. The combined magnetic strength of the inner magnet 36 and outer magnet 42 is preferably sufficient to keep a large, bulky, or heavy article 20, shown in FIG. 1, in place and withstand incidental movement of such article 20. The shape, size and magnetic strength of the magnets 36 and 42 are selected based on the shape, size and weight of the article 20 and the thickness of a typical garment. Various suitable magnets with strong magnetic properties are commercially available. A preferred magnet is the Neodymium-Iron-Boron disc-shaped magnet, grade 35 (35 million energy product) having a diameter of 0.5" and a thickness of 0.125", available from Master Magnetics, Inc., Castle Rock, Colo. 80104.

Many decorative articles are irregularly shaped or contain open areas that allow the garment to be seen through the decorative article. Therefore, the outer magnet 42 and socket 48 are preferably small enough to remain substantially concealed behind the decorative article 20. Preferably, however, the outer magnet 42 and inner magnet 36 are identical to maximize magnetic efficiency while minimizing size.

Now referring to FIGS. 6 and 7, a device in accordance with an alternate embodiment of the invention will be described. A rectangular-shaped inner magnet 62 has first 64 and second 66 surfaces of opposite magnetic polarity. A rectangular-shaped outer magnet 70 has first 72 and second 74 surfaces of opposite magnetic polarity, like those of the inner magnet 62. The outer magnet 70 has a tube 76 secured to its first surface 72 in a suitable manner, such as by a strong epoxy adhesive 78. An open-ended passageway 80 extends through the tube 76. Thus, the tube 76 serves as an anchor for the outer magnet 70. A decorative or informative article (such as shown in FIG. 1), can be secured to a garment 60 by passing the pin 26 through the passageway 80 and then bringing the magnets 62 and 70 into close proximity on opposite sides of the garment 60.

Figure 6:
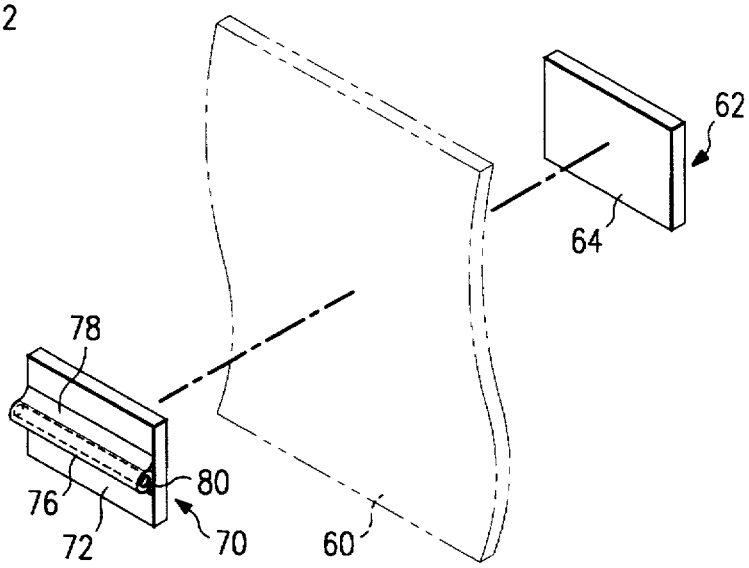
FIG. 6 is an exploded perspective view of a device in accordance with an alternative embodiment of the invention and a portion of a garment, which is shown broken away.
Figure 7:
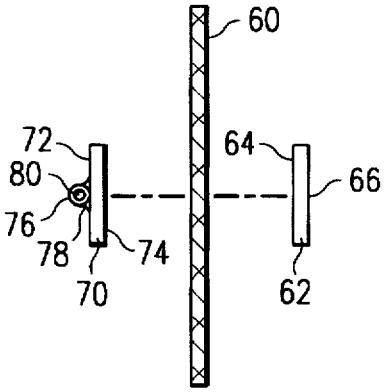
FIG. 7 is a side view of the device of FIG. 6 with a portion of a garment interposed between elements of the device.

It will be appreciated that the embodiment of FIGS. 6 and 7 may be altered to use disk-shaped magnets like those of FIGS. 2 and 3, with the tube 76 replacing the socket 48 as the anchor element. Also, in another variation, rectangular or other non-circular shaped magnets can be used in place of the disk-shaped magnets of FIGS. 2 and 3 with the socket 48 shaped to conform to such rectangular or other non-circular shape.

Although preferred embodiments of the invention have been described in detail, it will be appreciated that various alternatives and modifications thereof are within the spirit and scope of the invention as set forth in the appended claims.

What is claimed is:

1. A magnetic attachment device in combination with an article to be worn on a garment, the article having an outer face, a rear surface, and an elongated, substantially straight pin secured on the rear surface, the magnetic attachment device comprising:

an inner magnet having a first surface defining a first magnetic pole and a second surface defining a second magnetic pole opposite in polarity to the first magnetic pole;

an outer magnet having a first surface defining a first magnetic pole and a second surface defining a second magnetic pole opposite in polarity to the first magnetic pole; and an anchor secured to the outer magnet and having an elongated passageway for receiving the pin such that the article can be secured to the garment by inserting the pin through the passageway and bringing the first surface of the inner magnet and the second surface of the outer magnet into magnetically close proximity on opposite sides of the garment.

2. The magnetic attachment device of claim 1 wherein the anchor comprises a socket defining a cavity for receiving and retaining the outer magnet therein with the second surface of the outer magnet exposed, and the passageway is defined along an inner wall of the socket adjacent to the first surface of the outer magnet.

3. The magnetic attachment device of claim 2 wherein the periphery of the socket is crimped against the edges of the outer magnet to secure the outer magnet in the cavity of the socket.

4. The magnetic attachment device of claim 1 wherein the anchor comprises a tube secured to the first surface of the outer magnet.

5. The magnetic attachment device of claim 1 wherein the inner magnet and outer magnet consist of Neodymium-Iron-Boron magnets.

6. The magnetic attachment device of claim 1 wherein the inner magnet and outer magnet are disk-shaped and of like diameter.

7. The magnetic attachment device of claim 1 wherein the inner magnet and the outer magnet are rectangular-shaped.

8. A magnetic attachment device in combination with an article to be worn on a garment, the article having an elongated, substantially straight pin hingedly attached to the back thereof and a clasp for securing the pin in a closed position, the magnetic attachment device comprising:

an inner magnet having a first surface defining a first magnetic pole and a second surface defining a second magnetic pole opposite in polarity to the first magnetic pole;

an outer magnet having a first surface defining a first magnetic pole and a second surface defining a second magnetic pole opposite in polarity to the first magnetic pole;

an anchor having walls defining a cavity and an elongated passageway extending between opposite sides of the anchor, the outer magnet being mounted in the cavity and secured by the walls with the second surface of the magnet exposed, the passageway being sized slightly larger than the diameter of the pin; and whereby the article can be secured to the anchor by passing the pin through the passageway and securing the pin in the closed position, and the article can be secured to the garment by bringing the first surface of the inner magnet and the second surface of the outer magnet into magnetically close proximity on opposite sides of the garment.

9. The magnetic attachment device of claim 8 wherein a soft polymer coating is included within the passageway such that the pin is frictionally engaged within the passageway by the coating.

10. The magnetic attachment device of claim 8 wherein the inner magnet and outer magnet consist of Neodymium-Iron-Boron magnets.

11. The magnetic attachment device of claim 8 wherein the inner magnet and outer magnet are disk-shaped and of like diameter.

12. The magnetic attachment device of claim 8 wherein the inner magnet and the outer magnet are rectangular-shaped.

13. The magnetic attachment device of claim 8 wherein the periphery of the anchor is crimped against the edges of the outer magnet to secure the outer magnet in the cavity of the socket.

14. The magnetic attachment device of claim 8 wherein the anchor is plated with a precious metal.

15. A magnetic attachment device in combination with an article to be worn on a garment, the article having a substantially straight pin secured to the back thereof, the magnetic attachment device comprising:

an inner magnet having a first surface defining a first magnetic pole and a second surface defining a second magnetic pole opposite in polarity to the first magnetic pole;

an outer magnet having a first surface defining a first magnetic pole and a second surface defining a second magnetic pole opposite in polarity to the first magnetic pole;

an anchor having walls defining a cavity, the cavity including a passageway for receiving the pin, the walls including a peripheral rim around the cavity corresponding in shape to the shape of the outer magnet, the outer magnet being mounted within the cavity and secured therein by tension applied by the peripheral rim to the edges of the outer magnet, the second surface of the outer magnet remaining exposed; and whereby the article can be secured to the garment by passing the pin through the passageway, clasping the pin in the locked position, and bringing the first surface of the inner magnet and the second surface of the outer magnet into magnetically close proximity on opposite sides of the garment.

16. The magnetic attachment device of claim 15 wherein the inner magnet and the outer magnet are Neodymium-Iron-Boron magnets.

17. The magnetic attachment device of claim 15 wherein the inner magnet and the outer magnet are disk-shaped.

18. The magnetic attachment device of claim 15 wherein the inner magnet and the outer magnet are rectangular-shaped.

19. The magnetic attachment device of claim 15 wherein the second surface of the outer magnet and the peripheral rim define a flush surface.

20. The magnetic attachment device of claim 15 wherein the anchor includes a back plate integrally formed with the peripheral rim, and the back plate includes a raised portion extending away from the cavity to define the passageway within the cavity.

21. A magnetic attachment device in combination with an article to be worn on a garment, the article having a pin hingedly attached to the back thereof and a clasp for securing the pin in a closed position, the magnetic attachment device comprising:

an inner magnet having a first surface defining a first magnetic pole and a second surface defining a second magnetic pole opposite in polarity to the first magnetic pole;

an outer magnet having a first surface defining a first magnetic pole and a second surface defining a second magnetic pole opposite in polarity to the first magnetic pole;

an anchor having walls defining a cavity and an elongated passageway extending between opposite sides of the anchor, the anchor including a soft polymer coating within the passageway such that the pin is frictionally engaged within the passageway by the coating, the outer magnet being mounted in the cavity and secured by the walls with the second surface of the magnet exposed, the passageway being sized slightly larger than the diameter of the pin; and whereby the article can be secured to the anchor by passing the pin through the passageway and securing the pin in the closed position, and the article can be secured to the garment by bringing the first surface of the inner magnet and the second surface of the outer magnet into magnetically close proximity on opposite sides of the garment.

22. The magnetic attachment device of claim 21 wherein the inner magnet and outer magnet consist of Neodymium-Iron-Boron magnets.

23. The magnetic attachment device of claim 21 wherein the inner magnet and outer magnet are disk-shaped and of like diameter.

24. The magnetic attachment device of claim 21 wherein the periphery of the anchor is crimped against the edges of the outer magnet to secure the outer magnet in the cavity of the socket.

25. A magnetic attachment device for attaching an article to a garment, the article having a pin on the back thereof, the magnetic attachment device comprising:

an inner magnet having a first surface defining a first magnetic pole and a second surface defining a second magnetic pole opposite in polarity to the first magnetic pole;

an outer magnet having a first surface defining a first magnetic pole and a second surface defining a second magnetic pole opposite in polarity to the first magnetic pole; and an anchor secured to the outer magnet and having a passageway for receiving the pin such that the article can be secured to the garment by inserting the pin through the passageway and bringing the first surface of the inner magnet and the second surface of the outer magnet into magnetically close proximity on opposite sides of the garment, wherein the anchor comprises a socket defining a cavity for receiving and retaining the outer magnet therein with the second surface of the outer magnet exposed, and the passageway is defined in the cavity along an inner wall of the socket adjacent to the first surface of the outer magnet.

26. The magnetic attachment device of claim 25 wherein the periphery of the socket is crimped against the edges of the outer magnet to secure the outer magnet in the cavity of the socket.

27. The magnetic attachment device of claim 25 wherein the inner magnet and outer magnet consist of Neodymium-Iron-Boron magnets.

28. The magnetic attachment device of claim 25 wherein the inner magnet and outer magnet are disk-shaped and of like diameter.

29. A magnetic attachment device for attaching an article having a pin on the back thereof to a garment, the magnetic attachment device comprising:

an inner magnet having a first surface defining a first magnetic pole and a second surface defining a second magnetic pole opposite in polarity to the first magnetic pole;

an outer magnet having a first surface defining a first magnetic pole and a second surface defining a second magnetic pole opposite in polarity to the first magnetic pole;

an anchor having walls defining a cavity corresponding in shape to the shape of the outer magnet, the cavity including a passageway for receiving the pin, the walls including a back plate integrally formed with a peripheral rim, the back plate including a raised portion extending away from the cavity to define the passageway, the outer magnet being mounted within the cavity and secured therein by tension applied by the peripheral rim to the edges of the outer magnet, the second surface of the outer magnet remaining exposed; and whereby the article can be secured to the garment by passing the pin through the passageway and bringing the first surface of the inner magnet and the second surface of the outer magnet into magnetically close proximity on opposite sides of the garment.

30. The magnetic attachment device of claim 29 wherein the inner magnet and the outer magnet are Neodymium-Iron-Boron magnets.

31. The magnetic attachment device of claim 29 wherein the inner magnet and the outer magnet are disk-shaped.

32. The magnetic attachment device of claim 29 wherein the second surface of the outer magnet and the peripheral rim define a flush surface.

* * * * *